US005997084A

United States Patent [19]

Barile, Jr. et al.

[11] Patent Number: 5,997,084

[45] Date of Patent: Dec. 7, 1999

[54] STACKABLE CHAIR

[75] Inventors: Peter W. Barile, Jr.; Peter Barile, both of Morristown, Tenn.

[73] Assignee: Shelby Williams Industries, Inc., Morristown, Tenn.

[21] Appl. No.: 09/119,881

[22] Filed: Jul. 21, 1998

[51] Int. Cl.[6] ..... A47C 3/04

[52] U.S. Cl. ..... 297/239; 297/463.1; 211/194

[58] Field of Search ..... 297/239, DIG. 1, 297/463.1; 211/194

[56] References Cited

U.S. PATENT DOCUMENTS

| | | | |
|---|---|---|---|
| 2,913,040 | 11/1959 | Abajian | 297/239 X |
| 3,031,227 | 4/1962 | Buren, Jr. | 297/239 |
| 3,038,758 | 6/1962 | Molla | 297/239 X |
| 3,102,733 | 9/1963 | Burnett | 297/239 X |
| 3,246,928 | 4/1966 | Haynes et al. | 297/239 |
| 3,316,016 | 4/1967 | Petersen | 297/239 |
| 3,856,352 | 12/1974 | Jacobi, Sr. | 297/239 X |
| 4,655,504 | 4/1987 | Weber | 297/239 |
| 5,524,963 | 6/1996 | Barile | 297/239 |

*Primary Examiner*—Peter M. Cuomo
*Assistant Examiner*—Rodney B. White
*Attorney, Agent, or Firm*—Pitts & Brittian, P.C.

[57] ABSTRACT

A stackable chair is provided which is configured to alter the forward shift of the center of gravity of a stack of the chairs such that a larger number of such chairs can be stacked in a stable stack as compared to a stack of prior art chairs. The stackable chair includes a seat member, a seat back extending from the seat member, a plurality of legs secured to the seat member and a seat pan secured to the bottom of the seat member. The seat member defines a wedge shape and the seat pan is disposed at angle with respect to the seat member. The seat member and the seat pan cooperate to alter the forward shift of the center of gravity to an arcuate path when the chairs are placed in a stack. Further, the seat pan is configured to protect the seat cushion upon which it rests against indentations.

4 Claims, 5 Drawing Sheets

STACKABLE CHAIR

TECHNICAL FIELD

This invention relates to the field of stackable chairs and more specifically to a stackable chair which when stacked one upon another provides a stable stack of chairs.

BACKGROUND ART

Conventional stackable chairs are configured to permit stacking one on top of another for storage. Specifically, the seat bottom of an additional chair is supported on the seat cushion of the chair upon which it is stacked and the seat back of each additional chair is disposed in front of the seat back of the chair upon which it is stacked. A common problem with stackable chairs is that, with each additional chair added to the stack, the center of gravity of the stack shifts forward. When too many chairs are added to the stack, it becomes unstable and is easily tipped over. Consequently, the number of chairs which can be placed in a stack is limited.

Further, it is common in the construction of stackable chairs to secure the legs to the under side of the seat. When the chairs Are stacked, the legs from the chair above can leave impressions in the seat cushion of the chair below. These impressions are aesthetically undesirable and over a period of time can damage the seat cushion requiring replacement of the seat cushion or replacement of the chair.

U.S. Pat. No. 5,524,963 discloses a stacking interface secured to the underside of the seat member of a chair. The stacking interface serves to alter the stacked disposition of the chair to facilitate the stable stacking of such chair on a stack of chairs. The interface is visible from the front of the chair which is aesthetically undesirable.

Therefore, it is an object of the present invention to provide a stackable chair which allows a greater number of chairs to be stacked for storage without the stack becoming unstable.

It is yet another object of the present invention to provide a stackable chair with a simple construction.

Further, it is an object of the present invention to provide a stackable chair which, when in a stacked position, protects the cushion of each chair from impressions.

SUMMARY

Other objects and advantages will be accomplished by the present invention which provides a stackable chair which is configured to alter the forward shift of the center of gravity of a stack of chairs such that a larger number of chairs can be placed in a stack than permitted by chairs of the prior art. The stackable chair generally includes a seat member, a seat back which extends upwardly from a rear portion of the seat member, a plurality of legs extending downward from the seat member and a seat pan mounted to the bottom of the seat member which is disposed at an angle relative to the lower surface of the seat member and serves to protect the seat cushions against indentations when the chairs are stacked. A seat cushion is mounted to the seat member and defines a wedge-like configuration. When stacking the chairs, the seat cushion and the angularly disposed seat pan cooperate to tilt the chair with respect to the chair upon which it rests thereby shifting the center of gravity in an arcuate line. With the center of gravity shifted in an arcuate line, more chairs can be stacked one on another than the traditional stackable chairs, wherein the center of gravity shifts in a linear path.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

A stackable chair incorporating various features of the present invention is illustrated generally at 10 in the figures. The stackable chair 10 is designed to alter the stacked disposition of a plurality of chairs 10 such that a stable stack is provided. Further, in the preferred embodiment, the stackable chair 10 provides a means for protecting the cushion of each chair from impressions when the stackable chairs are in a stack.

Figure 1:
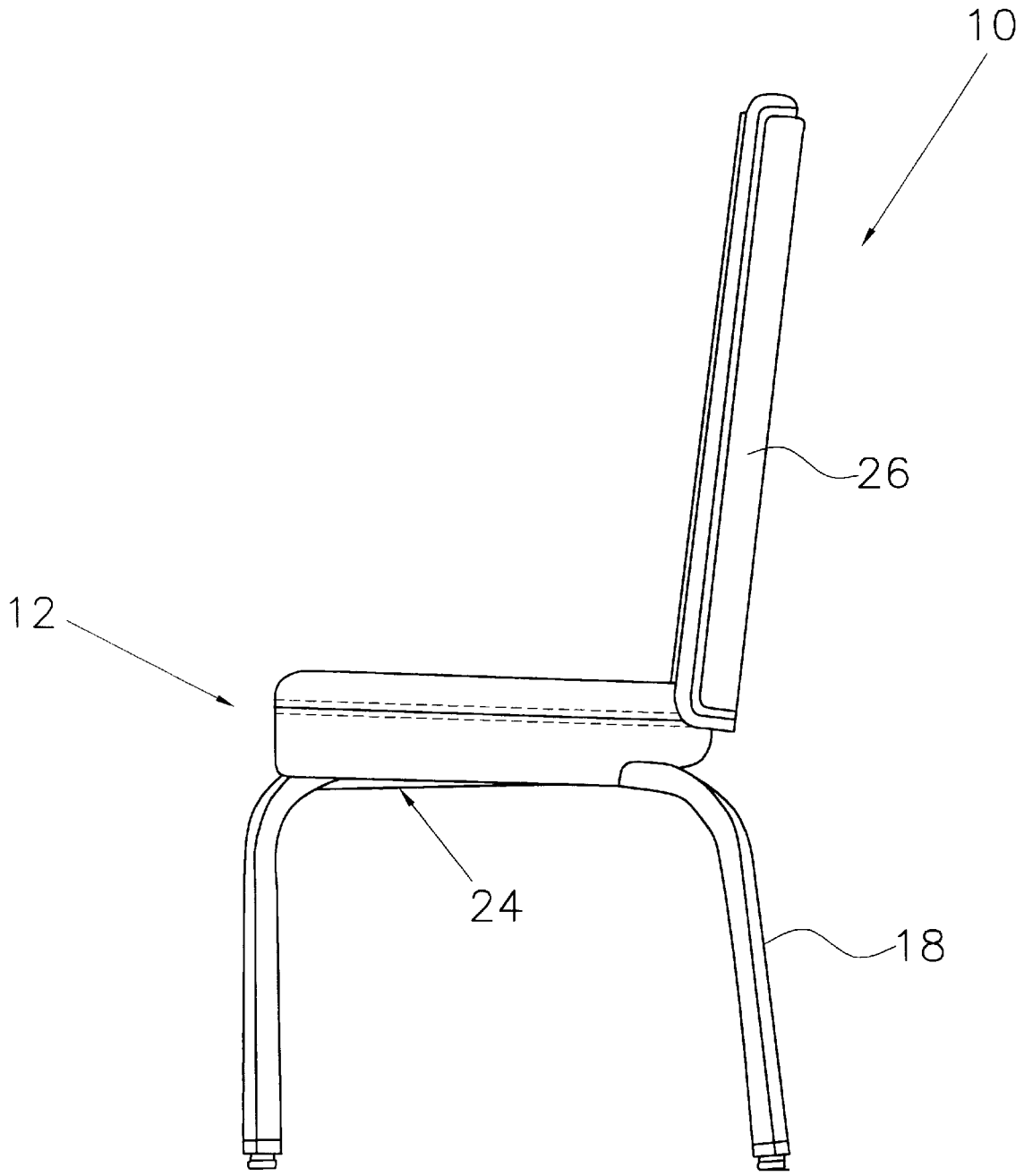
FIG. 1 is a side view of the stackable chair of the present invention.

As shown in FIG. 1, the stackable chair 10 of the present invention generally includes a seat member 12, a seat back 26 which extends upwardly from a rear portion of the seat member 12, a plurality of legs 18 extending downwardly from the seat member 12 and a seat pan 24 mounted to the bottom of the seat member 12. The seat pan 24 is disposed at an angle relative to the lower surface 22 of the seat member 12. The seat pan 24 also serves to protect the seat cushion of the chair upon which it is stacked against indentations.

Figure 2:
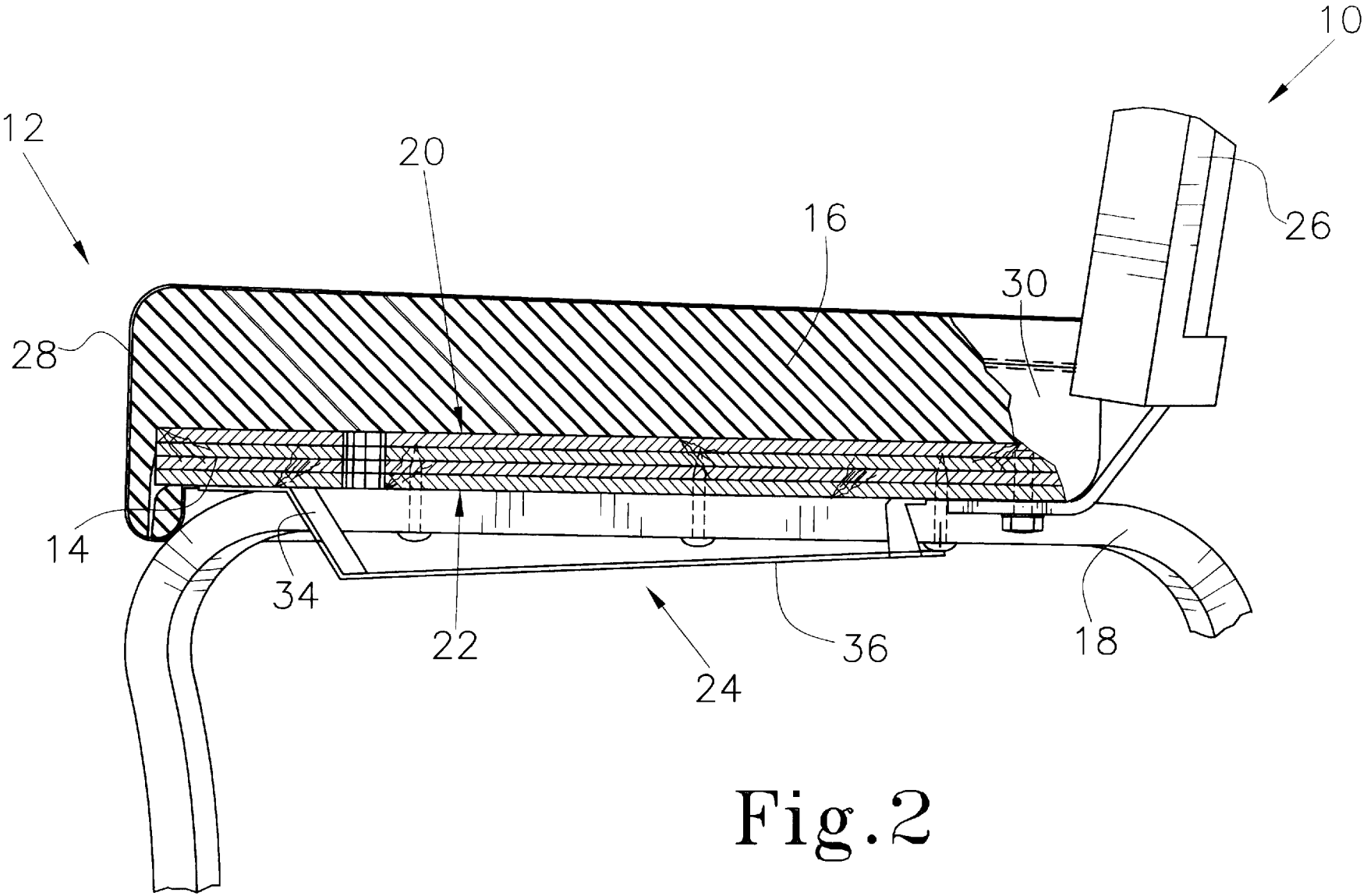
FIG. 2 is a cross sectional view of the seat member of the stackable chair of the present invention.

As shown in FIG. 2, the seat member 12 includes a seat cushion 16 and a seat base 14. The seat cushion 16 is mounted to the upper side 20 of the seat base 14 and the legs 18 are mounted to the under side 22 of the seat base 14. The seat cushion 16 defines a wedge-shaped configuration wherein the front 28 of the cushion is thicker than the rear 30 of the cushion. In the preferred embodiment, the front 28 of the seat cushion 16 is approximately 2⅜ inches thick and the rear 30 of the seat cushion 16 is approximately 2 inches thick. Further, the seat cushion 16 is fabricated from a dense foam rubber.

Figure 4:
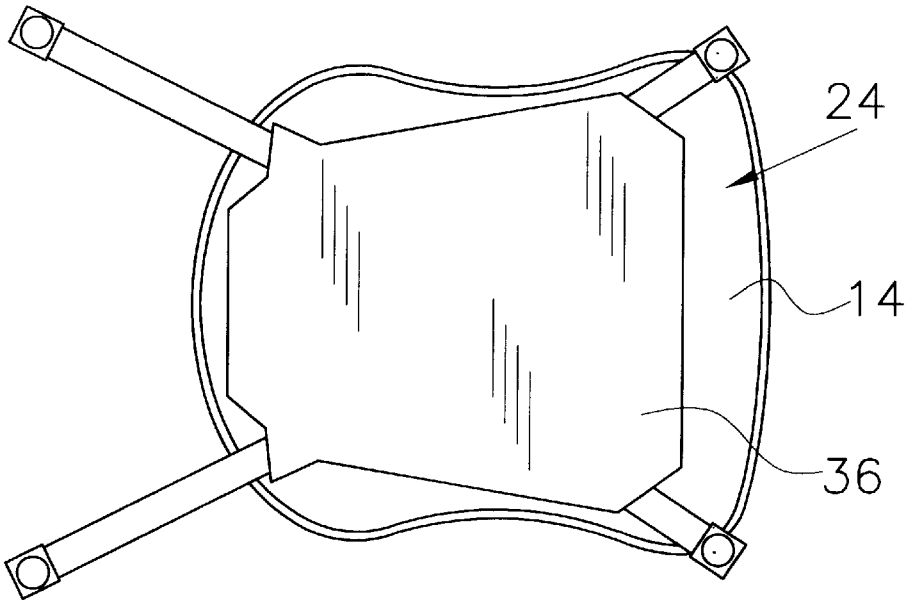
FIG. 4 illustrates the bottom of the seat member with the seat pan.
Figure 3:
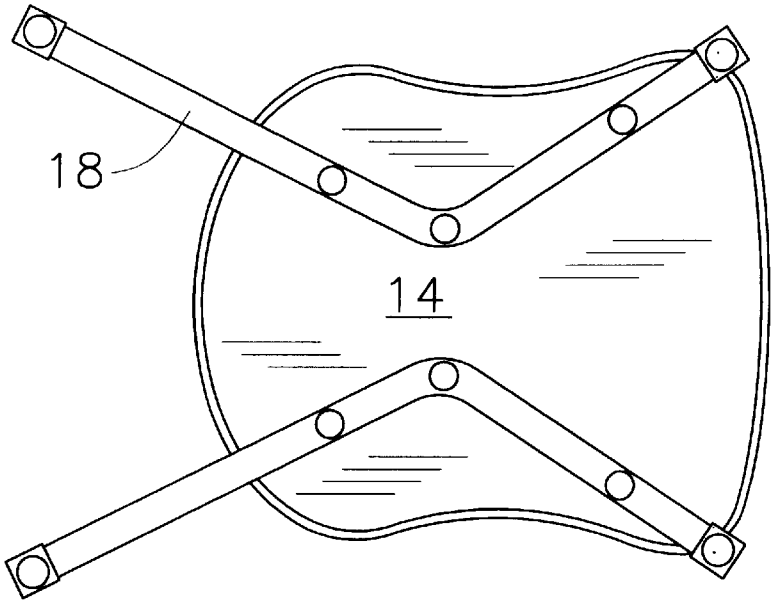
FIG. 3 illustrates the bottom of the seat member without the seat pan.

The seat pan 24 is illustrated in FIGS. 2 and 4 and is mounted to the bottom 22 of the seat base 14. Specifically, the seat pan 24 defines a cushion shield 36 and at least two tabs 34 extending from opposing sides of the cushion shield 36. The tabs are secured to the bottom 22 of the seat base 14. The tabs 34 extending from the front of the seat pan 24 are longer in length than the tabs 34 extending from the rear of the seat pan 24 such that the cushion shield 36 is disposed at an angle relative to the lower side 22 of the seat base 14, as shown in FIG. 2. In the preferred embodiment, the length of the tabs extending from the front of the seat pan 24 is such that the front of the cushion shield 36 extends downward approximately ⅜ of an inch from the portion of the legs 18 secured to the seat base 14. The cushion shield 36 is configured to at least cover the portion of the legs 18 which engage the seat base 14. A bottom view of the seat base 14 with the legs 18 secured thereto is illustrated in FIG. 3. FIG. 4 illustrates the bottom of the seat base 14 with the seat pan 24 secured thereto. The seat pan 24 is fabricated from a rigid material. In the preferred embodiment, the seat pan 24 is fabricated from cardboard and covers a substantial portion of the bottom of the seat base 14. It will be noted that the seat pan can also be fabricated from wood, plastic or metal.

Figure 5:
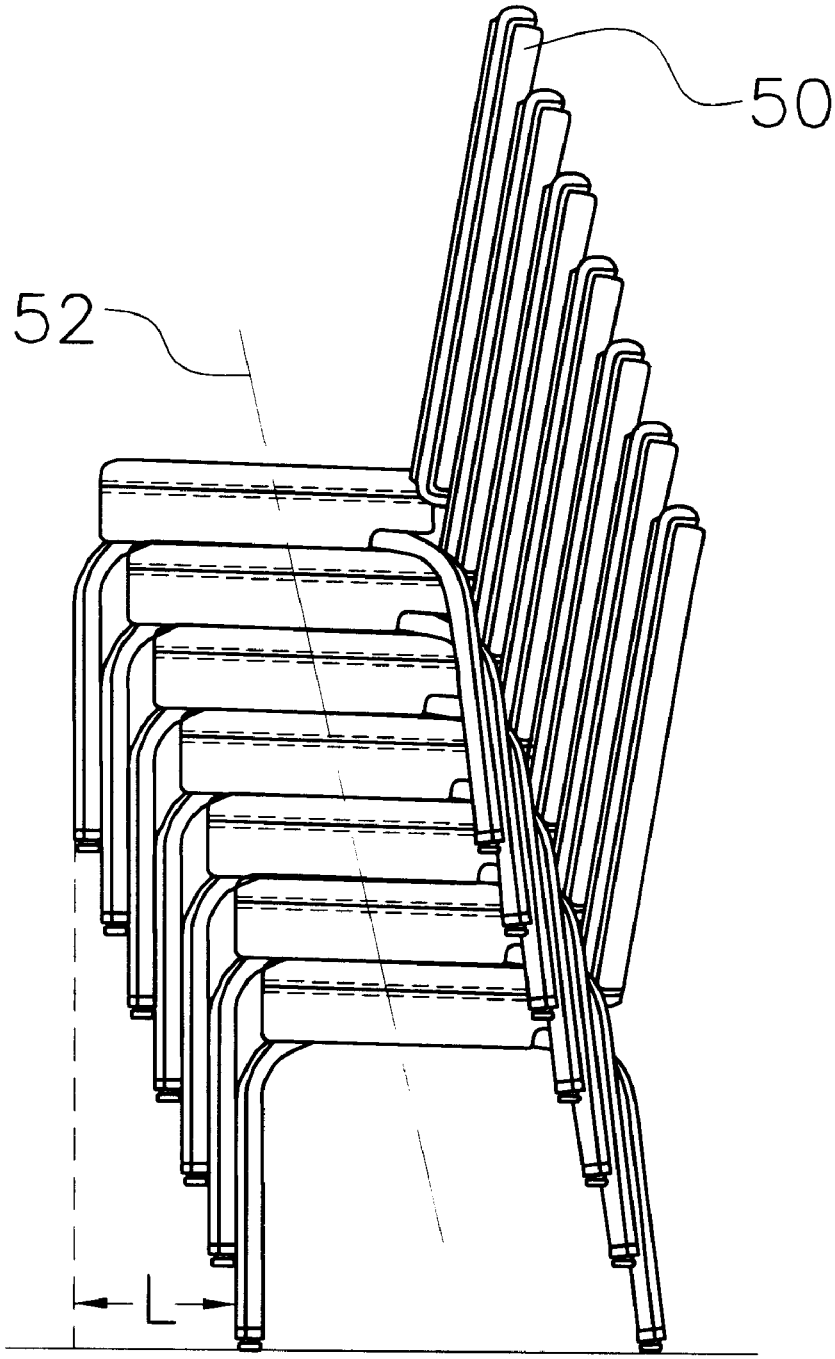
Fig.5 (PRIOR ART)
FIG. 5 illustrates a plurality of chairs of the prior art in a stacked position; and, FIG. 6 illustrates a plurality of the stackable chairs of the present invention in a stacked position.

When stacking the chairs 10, the seat cushion 16 arid the seat pan 24 cooperate to alter the angular disposition of one chair 10 relative to another chair 10 upon which it is stacked, due to the wedge-like configuration of the seat cushion 16 and the angled disposition of the seat pan 24. By way of comparison, FIG. 5 illustrates six prior art chairs 50 in a stacked configuration, with the portion of the legs which engage the seat member being supported on the seat cushion of the chair below. In this stacked configuration, the center of gravity of the stack shifts forward in a substantially linear path with the addition of each chair 50 to the stack. The line 52 shown in FIG. 5 indicates the approximate shift of the center of gravity. This shift limits the number of chairs which can be stacked in a stable stack.

Figure 6:
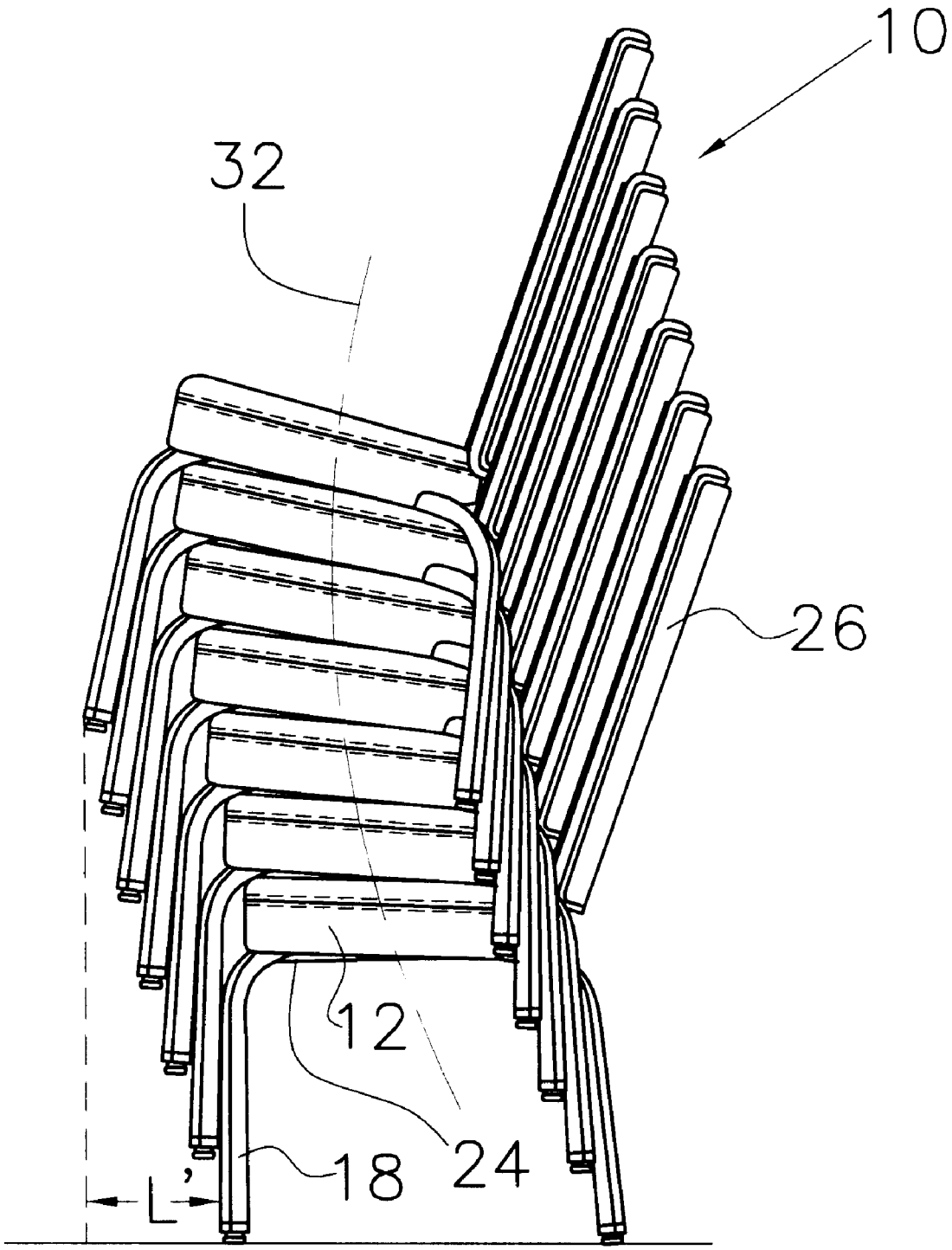

FIG. 6 illustrates six stackable chairs 10 of the present invention in a stack. The wedge-like configuration of the seat cushions 16 and the angular disposition of the seat pan 24 serves to alter the angular disposition of each stacked chair 10 with respect to the chair 10 upon which it rests and specifically tilts the chair 10 rearward with respect to chair 10 upon which it rests. Accordingly, as chairs 10 are added to the stack, the center of gravity shifts forward, but the shift is in an arcuate path as indicated by the line 32 in FIG. 6. This shift permits a larger number of chairs 10 to be stacked in a stable manner. It will be noted that it is conventional for the seat member to be slanted, as shown in the prior art chair of FIG. 5. This slant is not sufficient to alter the angular disposition of a chair when it rests upon another chair. The wedge-like configuration of the seat cushion 16 provides the additional slant which cooperates with the angled seat pan to shift the center of gravity to the arcuate path illustrated in FIG. 6.

As indicated above, the forward shift of the stack of chairs 10 of the present invention is less than the forward shift of the stack of prior art chairs 50 and is specifically illustrated in a comparison of FIG. 5 to FIG. 6. The distance L in FIG. 5 illustrates the forward shift of the prior art chairs 50 and the distance L' in FIG. 6 illustrates the forward shift of the stackable chairs 10 of the present invention. The distance L of the prior art is substantially larger than the distance L' of the present invention.

When the chairs 10 are stacked, the portion of the legs 18 secured to the seat member leave an impression in the seat cushion 16 of the chair 10 below without the seat pan 24 in place. The cushion shield of the seat pan 24 covers the portion of the legs 18 mounted to the seat member 12 and provides a flat surface which rests on the seat cushion 16 below it when the chairs 10 are stacked thereby protecting the seat cushion 16 upon which it rests.

From the foregoing description, it will be recognized by those skilled in the art that a stackable chair offering advantages over the prior art has been provided. Specifically, the stackable chair is configured such that a greater number of chairs can be stacked for storage without the stack becoming unstable. Further, the stackable chair is simply constructed. Moreover, when in a stacked position, the chair provides a means to protect the cushion of each chair from impressions.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A stackable chair comprising:

a seat member defining a seat base and a seat cushion, said seat base defining a top and a bottom, said seat cushion being secured to said top of said seat base, said seat cushion defining a wedge-shaped configuration;

a seat back extending from a rear of said seat member;

a plurality of legs mounted to said bottom of said seat base; and a seat pan mounted to said bottom of said seat base, said seat pan being angularly disposed with respect to said seat base, said seat pan and said seat cushion cooperating to shift the center of gravity of a stack of said stackable chairs to an arcuate path, said seat pan defining a cushion shield and at least two tabs extending from opposing sides of said cushion shield, said at least two tabs being secured to said bottom of said seat base and extending downward therefrom, said at least two tabs extending from a front portion of said cushion shield such that said cushion shield is disposed at an angle relative to said seat base.

2. The stackable chair of claim 1 wherein said cushion shield covers said portion of plurality of legs secured to the said bottom of said seat base and defines a flat surface.

3. The stackable chair of claim 1 wherein said seat pan is fabricated from a rigid material.

4. A stackable chair comprising:

a seat member defining a seat base and a seat cushion, said seat base defining a top and a bottom, said seat cushion being secured to said top of said seat base, said seat cushion defining a wedge-shaped configuration;

a seat back extending from a rear of said seat member;

a plurality of legs mounted to said bottom of said seat base; and, a seat pan mounted to said bottom of said seat base, said seat pan being angularly disposed with respect to said seat base, said seat pan defining a cushion shield and at least two tabs extending from opposing sides of said cushion shield, said at least two tabs being secured to said bottom of said seat base and extending downward therefrom, said at least two tabs extending from a front portion of said cushion shield such that said cushion shield is disposed at an angle relative to said seat base, said cushion shield covering said portion of plurality of legs secured to the said bottom of said seat base and providing a flat surface, said seat pan and said seat cushion cooperating to shield the center of gravity of a stack of said stackable chairs to an arcuate path, said seat pan being fabricated from a rigid material.

* * * * *